US005855136A

United States Patent [19]

Häusler et al.

[11] Patent Number: 5,855,136

[45] Date of Patent: Jan. 5, 1999

[54] PROCESS AND DEVICE FOR THREADING ELONGATED METAL WORKPIECES, ESPECIALLY TUBES, INTO A DRAWING APPARATUS

[75] Inventors: Karl-Heinz Häusler, Korschenbroich; Erling Roller, Essen; Karl-Heinz Kemmerling, Möchengladbach, all of Germany

[73] Assignee: Mannesmann Aktiengesellschaft, Düsseldorf, Germany

[21] Appl. No.: 911,522

[22] Filed: Aug. 14, 1997

[30] Foreign Application Priority Data

Aug. 29, 1996 [DE] Germany ..... 196 36 322.5

[51] Int. Cl.[6] ..... B21C 1/22; B21C 1/32

[52] U.S. Cl. ..... 72/291; 72/287; 72/282

[58] Field of Search ..... 72/290, 291, 287, 72/283, 282, 278

[56] References Cited

U.S. PATENT DOCUMENTS

| | | | |
|---|---|---|---|
| 2,742,144 | 4/1956 | Meyerbach | 72/290 |
| 4,805,434 | 2/1989 | Komp | 72/282 |
| 5,660,071 | 8/1997 | Sauvonnet | 72/290 |

FOREIGN PATENT DOCUMENTS

| | | |
|---|---|---|
| 182 922 | 6/1986 | European Pat. Off. . |
| 548 723 | 6/1993 | European Pat. Off. . |
| 645 200 | 3/1995 | European Pat. Off. . |

*Primary Examiner*—Daniel C. Crane

*Attorney, Agent, or Firm*—Cohen, Pontani, Lieberman & Pavane

[57] ABSTRACT

A process and a device for threading elongated tubes into a drawing apparatus for cross-sectional reduction in at least one drawing step by means of at least two successive drawing units that grasp the workpiece at the outer circumference with revolving driving chains which, after the drawing point formed at the start of the tube is threaded in, draw the workpiece continuously through a drawing ring which is arranged in front of each drawing unit. The device includes at least two chain-type drawing machines 1, 2, 3 which are arranged one behind the other with driving chains, 1*a* to 3*a* and 1*b* to 3*b*, which move apart radially and with a gripper 8 arranged behind every chain-type drawing machine 1, 2, 3 for grasping the drawing point 6 which is formed at the beginning of the tube. The gripper 8 is swivelable from a rest position laterally to and outside of the drawing line into a work position in which the gripper 8 is movable in the drawing direction between the driving chains, 1*a* to 3*a* and 1*b* to 3*b*, which are moved apart.

8 Claims, 1 Drawing Sheet

PROCESS AND DEVICE FOR THREADING ELONGATED METAL WORKPIECES, ESPECIALLY TUBES, INTO A DRAWING APPARATUS

BACKGROUND OF THE INVENTION

1. Field of the Invention

The present invention is directed to a process and a device for threading elongated metal workpieces, in particular pipes or tubes, into a drawing apparatus for cross-sectional reduction in more than one drawing step by means of at least two successive drawing units which grasp the workpiece at the outer circumference and have revolving chains which draw the workpiece continuously through a drawing ring associated with each drawing unit and arranged in a drawing ring holder.

2. Description of the Related Art

Continuous drawing machines are well known and are used, preferably for copper pipes or tubes, with two alternately acting drawing sledges, as for example disclosed in European Patent publication 0182922, or a chain-type drawing machine such as that disclosed in European Patent publication 0548723.

In order to initiate the drawing process, it is conventional in the prior art to draw out the pointed beginning of the tube, also referred to as the "point", in a plurality of steps until the actual drawing devices are capable of fully grasping the tube with the clamping jaws of the first drawing carriage or with the chains of the first chain-type drawing machine in order to be able to apply the drawing force to the tube. For example, European Patent Application 0645200 describes a device by means of which the tube is predrawn on the first piece, that is, its wall and diameter are reduced, whereby the beginning of the tube is fed by the appropriate length to the revolving chains, so that these chains grasp the tube along their entire length already during the initial drawing. Naturally, this process entails time losses and represents a clear limitation of the productive capacity of conventional continuous drawing machines. Further, prior art continuous drawing machines must be provided with auxiliary devices which are used within the cycle for drawing a tube and thus, not only complicate the plant or installation, and as a result make it more expensive, but also impede productive capacity.

The object of the present invention, therefore, is to provide a process and a device in which the duration of the threading process associated with the method and the duration of the predrawing of the tubes is substantially reduced with relatively little, if any, reduction in the drawing speed of the drawing units.

SUMMARY OF THE INVENTION

The present invention is directed to a process for threading tubes into a drawing device for cross-sectional reduction in at least one drawing step by means of at least two successive drawing units which grasp the workpiece at the outer circumference with revolving driving chains which, after the drawing point formed at the start of the tube is threaded in, draw the workpiece continuously through a drawing ring which is arranged in front of each drawing unit. First, the driving chains of the first drawing unit are moved apart transversely to the drawing axis. For the purpose of detecting the tube point projecting out of the drawing ring, a gripper arranged behind the drawing unit is introduced, in the direction opposite to the drawing direction, into the intermediate space between the driving chains. Then, the gripper grasps the drawing point projecting out of the drawing ring and draws the start of the tube through the driving chains. The revolving chains are then closed and grasp the start of the tube at its circumference. The gripper is disengaged and swiveled into a position adjacent to the drawing line while the driving chains are running. Then, the tube is transported to the front of the following drawing unit and the driving chains of the following drawing unit are moved apart transversely to the drawing axis. These steps are repeated in the following drawing unit or drawing units.

By shifting the threading process for the tube to the drawing device itself, the amount of nonproductive time is significantly reduced, especially since the drawing units continue to work during the threading time. In so doing, the drawing process is not interrupted.

Since the preceding drawing unit continues to run during the threading process in the subsequent or following drawing unit, a back-up of drawing stock occurs between the two machines when the drawing point enters the drawing ring for the following machine. The tube buckles toward the side and forms a curve, which is a desired effect for the continued process. The curve which is formed in this way may be partially or completely reduced in part or in its entirety after the closing of the driving chains of the following drawing unit and serves to compensate for difference in speed during the threading process. The driving motors of the drawing chains are controlled with respect to their rate of rotation in dependence on the drawing force in order to reduce the curve.

In another embodiment of the present invention, the deflection of the curve from the straight line is detected by sensor elements and controlled in magnitude as a function of drawing force and/or drawing speed to compensate for differences in speed. By retaining a residual curve, fluctuations in speed are eliminated in a relatively simple manner by controlling the curve itself.

It is also within the intended scope of the invention to coil the drawing stock after the last drawing unit and to feed it once again to the first drawing unit for another drawing step. Thus, multiple passes may be realized in which a tube traverses the installation two or more times.

A device for carrying out the process is characterized by at least two chain drawing machines which are arranged one behind the other with driving chains which move apart radially and with a griper which is arranged behind every chain-type drawing machine for grasping the drawing point which is formed at the beginning of the tube and which is swivelable from a rest position laterally to and outside of the drawing line into a work position in which the gripper is movable in the drawing direction between the driving chains which are moved apart.

Thus, in accordance with the present invention, the beginning of the tube is drawn through the opened driving chain by means of a gripper during operation in a combination of at least two chain drawing machines arranged one behind the other.

A free space is preferably provided between two adjacent drawing units to form a curve deflecting the drawing stock out of the straight line. Sensors which communicate in a control-type connection with the driving motors for the chain drives are arranged for detecting the magnitude of the curve. The curves serve to compensate for differences in speed between the successive drawing units, wherein the magnitude of the deflecting curve is a measurement for the speed difference. By detecting the position of the curve by means of sensors, the corresponding speeds may be adapted to one another by controlling the rate of rotation of the driving motors.

The sensors for detecting the magnitude of the curve can be constructed, for example, as diode row barriers which send a signal to a computer for processing which accordingly controls the driving motors for the driving chains.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figures 1, 2, 3, 4:
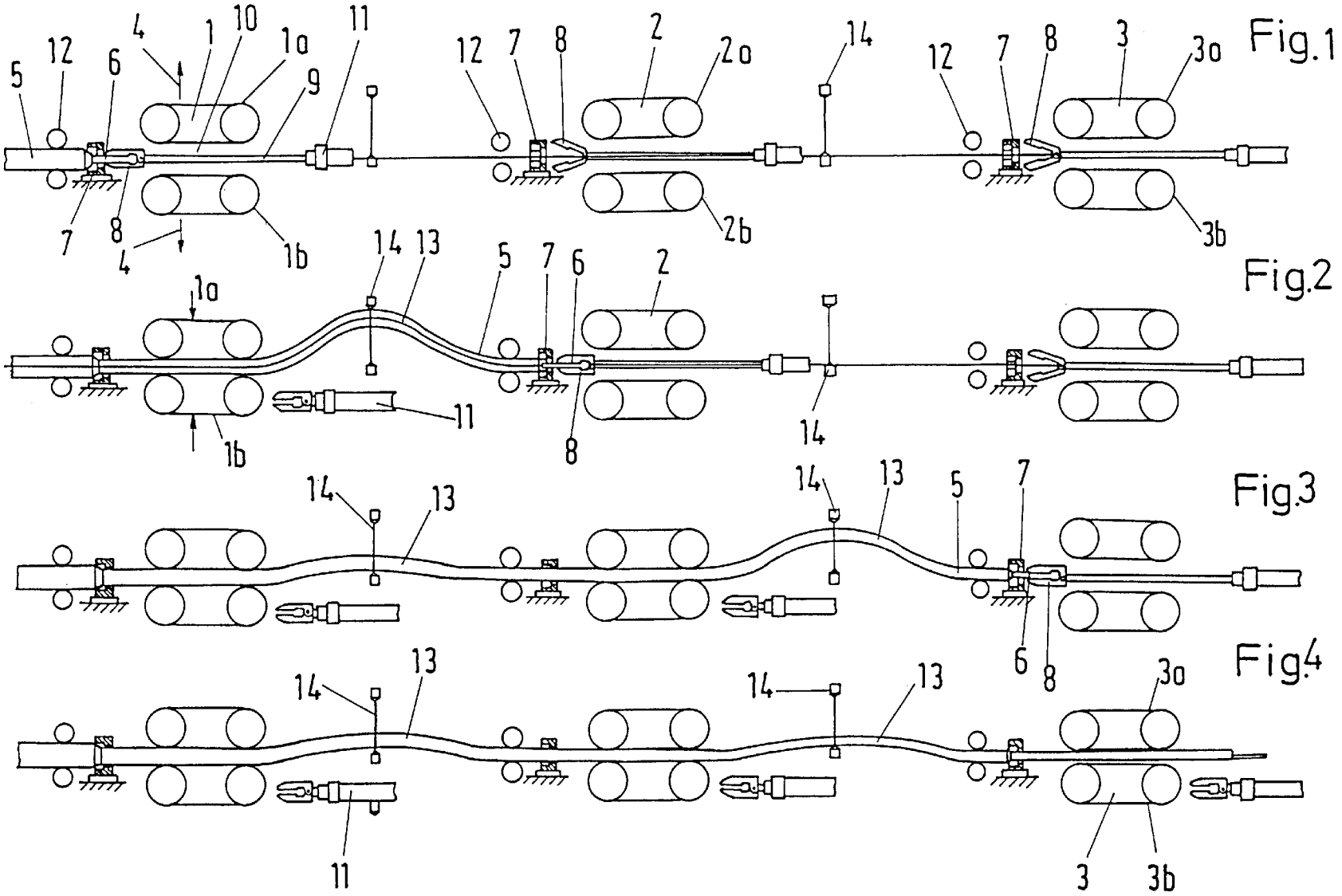
FIGS. 1 through 4 show the sequential process of threading the start of a tube into three drawing units constructed as chain-type drawing machines arranged one behind the other in accordance with the present invention.

In FIGS. 1 through 4, the chain-type drawing machines are designated by 1, 2 and 3, the upper driving chains are correspondingly designated by 1*a*, 2*a* and 3*a*, and the lower driving chains are designated by 1*b*, 2*b* and 3*b*. Although three drawing machines are illustrated in the Figures, three or more drawing machines arranged one behind the other are also within the intended scope of the invention.

In FIG. 1, the start of a tube 5 to be drawn is shown upstream of the first chain-type drawing machine 1 with driving chains 1*a*, 1*b* which are moved apart in the direction indicated by the arrow 4. A drawing point 6 of the tube 5 is inserted through a drawing ring 7 and grasped by a gripper 8. The gripper 8 is pushed by a lengthened portion 9 through an intermediate space 10 between driving chains 1*a*, 1*b* and positioned in front of the chain-type drawing machine 1. Actuating members 11 for the gripper 8 are positioned downstream of the chain-type drawing machine 1. The grippers 8 of the chain-type drawing machines 2 and 3 arranged downstream of the first chain-type drawing machine 1 are situated in the opened state in front of the respective drawing rings 7 and wait for the drawing point 6 of the tube 5 after the latter has passed through the preceding chain-type drawing machine 1. Driving rollers 12 which operate in a conventional manner are arranged upstream of the respective drawing rings 7 for introducing the tube 5.

In FIG. 2, the start of the tube 5 has already been drawn through the intermediate space 10 between the driving chains 1*a*, 1*b* of the first chain-type drawing machine 1 by the gripper 8 which was swiveled out laterally from the drawing line after exiting the intermediate space 10 and positioned in that location. At the same time, the driving chains 1*a*, 1*b* have been closed in the direction indicated by the arrows so as to contact the circumference of the tube 5 and drive the tube in the direction of the second chain-type drawing machine 2. After the drawing point 6 has penetrated the drawing ring 7, the gripper 8 of the second chain-type drawing machine 2 grasps the drawing point 6 and draws the start of the tube 5 through the open driving chains 2*a*, 2*b* of the second chain-type drawing machine 2 until the start of the tube 5 is situated between the driving chains 2*a*, 2*b* which are then closed so as to transport the tube in the direction of the third chain-type drawing machine 3. As is shown in FIG. 2, a curve 13 is formed during the threading of the tube point 6 into the drawing ring 7 which causes the tube to be deflected laterally from the straight line and bend. The magnitude of this curve is monitored by sensors 14 which control the drives (not shown) of the driving chains 1*a* to 3*a* and 1*b* to 3*b* so that the curve 13, as shown in FIG. 3, is at least partially compensated.

In FIG. 3, the start of the tube 5 reaches the drawing ring 7 upstream of the third chain-type drawing machine 3. The drawing point 6 is inserted through the drawing ring 7 and grasped by the gripper 8. In a similar manner as described above, the start of the tube 5 is now drawn through the drawing ring 7 accompanied by a simultaneous reduction in diameter until the gripper 8 has moved through the intermediate space between the driving chains 3*a*, 3*b*. The driving chains 3*a*, 3*b* are then also closed, the gripper 8 is swiveled away to the side, and the drawing process is continued in the chain-type drawing machine 3. During the drawing of the tube in the three chain-type drawing machines 1, 2, 3, the curves 13 between the machines may be partially maintained and used for controlling the speeds of the chain-type drawing machines. The grippers for threading the tubes into the drawing devices are then all swiveled laterally into a position next to the drawing axis and remain at rest there until the start of a new tube to be threaded into the drawing machines 1 to 3.

If a plurality of passes are provided, the tube is coiled up behind the third chain-type drawing machine and transported in a coil to the front of the first chain-type drawing machine 1, whereupon a second pass is performed through the chain-type drawing machines 1 to 2, wherein the driving chains 1*a*, 1*b*, 2*a*, 2*b*, 3*a*, 3*b* are either exchanged so as to be adapted to the new diameter or are outfitted from the start with two different diameters in two parallel lines adjacent to one another.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A process for threading tubes into a drawing device for cross-sectional reduction in at least one drawing step by means of at least two successive drawing units which grasp a workpiece along its outer circumference with revolving driving chains which, after a drawing point formed at a start of the tube is threaded in, draw the workpiece continuously through a drawing ring arranged in front of each drawing unit, said process comprising the steps of:

(a) opening the driving chains of a first drawing unit by moving the driving chains of the first drawing unit apart transversely relative to a drawing axis;

(b) introducing a gripper disposed downstream of the drawing unit, in a direction opposite to a drawing direction, into an intermediate space between the driving chains so as to detect a tube point projecting out from the drawing ring;

(c) grasping the drawing point projecting out from the drawing ring and drawing the start of the tube through the driving chains using the gripper;

(d) closing the driving chains by moving the driving chains together transversely relative to the drawing axis so as to grasp the start of the tube at its outer circumference;

(e) disengaging the gripper from the drawing point and swiveling the gripper into a position adjacent to the drawing axis while the driving chains are running;

(f) advancing the tube to a following drawing unit;

(g) moving apart transversely to the drawing axis the driving chains of the following drawing unit; and (h) repeating steps (b) through (e) for each following drawing unit.

2. The process in accordance with claim 1, wherein as the tube is threaded into the following drawing unit a curve deflecting the workpiece from the drawing axis develops between the drawing units by a preceding driving drawing unit.

3. The process in accordance with claim 2, wherein the curve is reduced at least partially after closing of the driving chains of the following drawing unit.

4. The process in accordance with claim 3, further comprising the step of controlling driving motors of the drawing chains with respect to their rate of rotation based on a drawing force so as to reduce the curve.

5. The process in accordance with claim 2, further comprising the step of detecting a magnitude of the curve from the drawing axis using a sensor and controlling the magnitude of the curve as a function of one of drawing force and drawing speed to compensate for differences in speed.

6. The process in accordance with claim 2, further comprising the step of coiling the workpiece after a last drawing unit and repeating steps (a) through (h).

7. A device for threading tubes into a drawing device for cross-sectional reduction in at least one drawing step comprising:

at least two chain drawing machines arranged one behind the other for grasping a workpiece along its outer circumference, each of said chain drawing machines comprising:

revolving driving chains radially displaceable relative to a drawing axis for drawing the workpiece; and driving motors, wherein adjacent chain drawing machines are separated from one another by a free space so that the workpiece may be deflected from a drawing axis so as to form a curve;

a drawing ring disposed upstream of each of said chain drawing machines through which the workpiece is continuously drawn by said driving chains after a drawing point formed at a start of the tube has been threaded;

a gripper disposed downstream of each of said chain drawing machines for grasping the drawing point at the start of the tube, said gripper being swivelable from a rest position laterally to and outside of the drawing axis to a work position in which said gripper is axially displaceable in a drawing direction between said driving chains when moved radially apart; and sensors for detecting a magnitude of the curve and controlling a speed of said driving motors of said driving chains.

8. The device in accordance with claim 7, wherein said sensors are diode row barriers.

* * * * *